US011225927B2

(12) United States Patent
Lou et al.

(10) Patent No.: US 11,225,927 B2
(45) Date of Patent: Jan. 18, 2022

(54) AIR-FUEL RATIO CONTROL SYSTEM FOR HYBRID ENGINE AND METHOD THEREOF

(71) Applicant: TONGJI UNIVERSITY, Shanghai (CN)

(72) Inventors: Diming Lou, Shanghai (CN); Liang Fang, Shanghai (CN); Piqiang Tan, Shanghai (CN); Yunhua Zhang, Shanghai (CN); Zhiyuan Hu, Shanghai (CN); Yafeng Shi, Shanghai (CN)

(73) Assignee: TONGJI UNIVERSITY, Shanghai (CN)

( * ) Notice: Subject to any disclaimer, the term of this patent is extended or adjusted under 35 U.S.C. 154(b) by 0 days.

(21) Appl. No.: 17/198,256

(22) Filed: Mar. 11, 2021

(65) Prior Publication Data

US 2021/0301750 A1 Sep. 30, 2021

(30) Foreign Application Priority Data

Mar. 24, 2020 (CN) ..... 202010214976.4

(51) Int. Cl.
*F02D 41/30* (2006.01)
*F02D 41/24* (2006.01)

(52) U.S. Cl.
CPC ..... *F02D 41/30* (2013.01); *F02D 41/2454* (2013.01); *F02D 2200/1004* (2013.01)

(58) Field of Classification Search
CPC ..... F02D 41/30; F02D 41/2454; F02D 2200/1004
See application file for complete search history.

(56) References Cited

U.S. PATENT DOCUMENTS

| | | | | |
|---|---|---|---|---|
| 6,279,531 | B1 * | 8/2001 | Robichaux | F02D 41/083 123/339.19 |
| 8,055,438 | B2 | 11/2011 | Neisen | |
| 9,863,342 | B2 | 1/2018 | Tulapurkar et al. | |
| 10,024,262 | B2 | 7/2018 | Sasaki et al. | |
| 2001/0037793 | A1 * | 11/2001 | Robichaux | F02D 41/083 123/339.19 |
| 2004/0144360 | A1 * | 7/2004 | Surnilla | F02M 69/044 123/339.11 |
| 2007/0131208 | A1 * | 6/2007 | Okazaki | F02D 41/1454 123/694 |

(Continued)

*Primary Examiner* — Carl C Staubach
(74) *Attorney, Agent, or Firm* — True Shepherd LLC; Andrew C. Cheng

(57) ABSTRACT

An air-fuel ratio control system for a hybrid vehicle engine is provided, including a torque coordination calculation module, which converts a target effective torque of a hybrid power control unit into a target indicated torque; a torque estimation module, which obtains an estimated indicated torque according to an operating state of an engine; an air-fuel ratio feedback control module, which generates a feedback correction factor based on deviation between the estimated indicated torque and the target indicated torque; and an air-fuel ratio feedforward control module, which converts the target indicated torque into an air-fuel ratio feedforward control signal according to a calibration parameter and engine speed. A target air-fuel ratio is obtained by correcting the air-fuel ratio feedforward control signal, via the feedback correction factor; and the target air-fuel ratio is configured to act on the engine to achieve air-fuel ratio control.

8 Claims, 4 Drawing Sheets

(56) References Cited

U.S. PATENT DOCUMENTS

| | | | | |
|---|---|---|---|---|
| 2008/0148712 | A1* | 6/2008 | Wada | F01N 9/00 60/285 |
| 2009/0107455 | A1* | 4/2009 | Pallett | F02D 41/30 123/299 |
| 2018/0086227 | A1* | 3/2018 | Healy | B60L 1/02 |

* cited by examiner

AIR-FUEL RATIO CONTROL SYSTEM FOR HYBRID ENGINE AND METHOD THEREOF

CROSS-REFERENCE TO RELATED APPLICATIONS

This application claims priority to Chinese Patent Application No. 202010214976.4 with a filing date of Mar. 24, 2020. The content of the aforementioned application, including any intervening amendments thereto, is incorporated herein by reference.

FIELD

The described embodiments relate to an automotive electronic control technology, and more particularly, to an air-fuel ratio control system for a hybrid vehicle engine and a method thereof.

BACKGROUND

In order to meet working conditions of a three-way catalytic converter, a hybrid vehicle engine needs to control an engine air-fuel ratio to be about an equivalent air-fuel ratio. Therefore, a circulating fuel injection quantity of a fuel injection system is determined by a circulating intake air quality, an air-fuel ratio, and a feedback value of a Lambda sensor.

A torque requirement of a hybrid vehicle engine comes from a hybrid control unit (HCU). In a steady-state process of driving, the HCU distributes a torque of each driving source according to an energy management strategy. In a mode switching and gear shifting process, the HCU will coordinate and control torque output of each driving source to achieve a smooth transition of the mode and shifting gear without power interruption.

The present disclosure is mainly aimed at control of air-fuel ratio, and factors that affect the air-fuel ratio of a premixed ignition engine instead of the equivalent air-fuel ratio, are mainly as the following descriptions.

1. Under high load conditions, exhaust temperature is higher than temperature limit of an aftertreatment system. In order to meet dynamic requirements, gas mixture is usually enriched to reduce the exhaust temperature.

2. In rapid acceleration conditions, oxygen in a cylinder needs to be consumed as much as possible, so it is necessary to enrich the gas mixture.

3. In throttle loosened conditions, it is generally adopted to cut fuel off.

4. In gasoline engine particulate filter (GPF) regeneration conditions, a certain amount of oxygen is required in exhaust gas, which is used for passive regeneration of deposited particulate matter in the GPF.

Regardless of limited exhaust temperature, the GPF regeneration, and other operating conditions, the hybrid vehicle engine will not have operating conditions of coasting and oil cut, so only the air-fuel ratio control requirements under the conditions of rapid acceleration and rapid deceleration are considered.

SUMMARY

The purpose of the present disclosure is to provide an air-fuel ratio control system for a hybrid vehicle engine and a method thereof, to overcome the above-mentioned defects in the related art.

The purpose of the present disclosure may be achieved by the following technical solutions.

The present disclosure provides an air-fuel ratio control system for a hybrid vehicle engine, including a torque coordination calculation module, configured to convert a target effective torque of a hybrid power control unit into a target indicated torque; a torque estimation module, configured to obtain an estimated indicated torque according to an operating state of an engine; an air-fuel ratio feedback control module, configured to generate a feedback correction factor based on a deviation between the estimated indicated torque of the torque estimation module and the target indicated torque of the torque coordination calculation module; and an air-fuel ratio feedforward control module, configured to convert the target indicated torque of the torque coordination calculation module into an air-fuel ratio feedforward control signal according to a calibration parameter and engine speed; wherein a target air-fuel ratio is obtained by correcting the air-fuel ratio feedforward control signal, via the feedback correction factor generated by the air-fuel ratio feedback control module; and the target air-fuel ratio is configured to act on the engine to achieve air-fuel ratio control.

The torque coordination calculation module is configured to convert the estimated indicated torque of the torque estimation module into an estimated effective torque; and the hybrid power control unit is configured to generate a motor torque control signal according to the estimated effective torque.

The torque coordination calculation module converting the target effective torque $T_{target\ effective}$ of the hybrid power control unit into the target indicated torque $T_{target\ indicated}$, includes the following.

$$T_{target\ indicated}=T_{target\ effective}+T_{friction}+T_{attachment}$$

$T_{friction}$ is a mechanical friction torque of the engine, and $T_{attachment}$ is a consumed torque by an attachment.

The operating state of the engine comprises engine inlet temperature and pressure, air-fuel ratio, and ignition advance angle.

After the air-fuel ratio feedback control module obtains the deviation between the estimated indicated torque and the target indicated torque, a feedback correction factor is generated according to a table.

The target air-fuel ratio is equal to a product of the air-fuel ratio feedforward control signal and the feedback correction factor; if the target air-fuel ratio is within a limit, the target air-fuel ratio is input into the engine; and if the target air-fuel ratio is out of the limit, the limit is input into the engine.

If a value that the target indicated torque minus the estimated indicated torque is greater than 10 N·m, gas mixture is enriched, and the feedback correction factor is between 0.95-1; if the value that the target indicated torque minus the estimated indicated torque is less than −10 N·m, a diluted combustion mode is adopted, and the feedback correction factor is between 1-1.6; and if an absolute value of the deviation between the target indicated torque and the estimated indicated torque is less than 10 N·m, the feedback correction factor is 1.

The present disclosure provides a system control method for an air-fuel ratio control system for a hybrid vehicle engine, including: converting, by a torque coordination calculation module, a target effective torque of a hybrid power control unit into a target indicated torque; obtaining, by a torque estimation module, an estimated indicated torque according to an operating state of an engine; converting, by an air-fuel ratio feedforward control module, the target indicated torque of the torque coordination calculation module into an air-fuel ratio feedforward control signal according to a calibration parameter and engine speed; generating, by an air-fuel ratio feedback control module, a feedback correction factor based on a deviation between the estimated indicated torque of the torque estimation module and the target indicated torque of the torque coordination calculation module; and obtaining a target air-fuel ratio by correcting the air-fuel ratio feedforward control signal by a feedback correction factor; wherein the target air-fuel ratio is configured to act on the engine to achieve air-fuel ratio control.

Compared with the related art, the present disclosure has the following advantages.

(1) An air-fuel ratio closed-loop control system of a hybrid vehicle engine enriches the gas mixture when the torque requirement rapidly rises. When the torque requirement rapidly reduces, the gas mixture is diluted. It may make the engine respond quickly and meet the torque satisfied the hybrid control unit requirements.

(2) A torque coordination calculation module is set. An interface module between an engine management system and a vehicle control system is responsible for the mutual conversion between the indicated torque and the effective torque. The indicated engine torque is directly affected by a heat release state of a combustion in a cylinder. The indicated torque is set as a control target of the engine control system, and it is conducive to precise control of the vehicle control system and the engine management system.

(3) Including the air-fuel ratio feedforward control module and the feedback control module, a simple and easy method is adopted to realize correction of the air-fuel ratio feedforward control signal, so that the air-fuel ratio control is more accurate.

DETAILED DESCRIPTION

The present disclosure will be described in detail below with reference to the drawings and specific embodiments. This embodiment is implemented on the premise of the technical solution of the present disclosure, and provides detailed implementation and specific operation procedures, but the protection scope of the present disclosure is not limited to the following embodiments.

Embodiment

Figure 1:
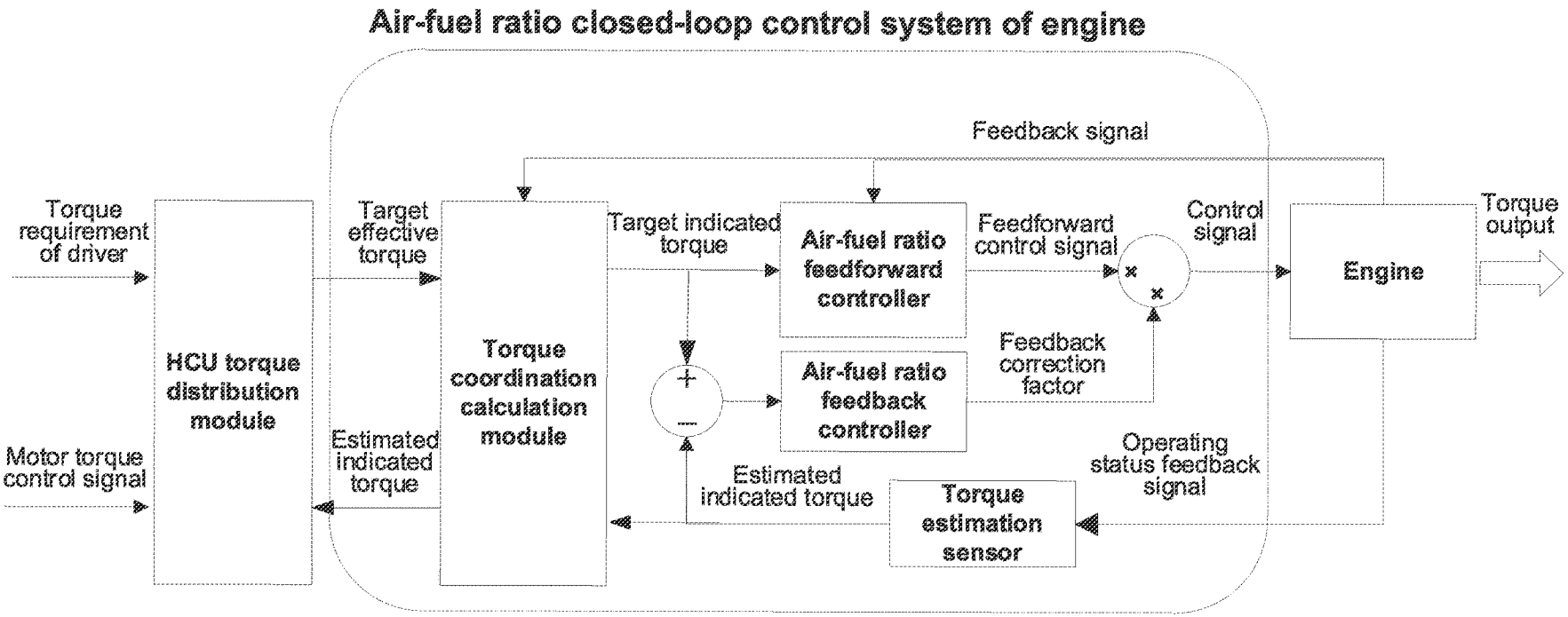
FIG. 1 is a structural illustration in the present disclosure.

This embodiment provides an air-fuel ratio control system for a hybrid vehicle engine. As shown in FIG. 1, the air-fuel ratio control system mainly includes the following modules: a torque coordination calculation module, an air-fuel ratio feedforward control module, a torque estimation module, and an air-fuel ratio feedback control module. Functions of each module are in the following descriptions.

The torque coordination calculation module is configured to calculate a current mechanical friction torque of an engine and a torque consumed by an attachment, and calculate a target indicated torque and an estimated effective torque, according to the target effective torque and the estimated indicated torque. The air-fuel ratio feedforward control module is configured to calibrate feedforward control parameters according to an engine performance test, use the parameters as a reference control parameter, and combine engine speed to convert the target indicated torque into an air-fuel ratio feedforward control signal. The torque estimation module is configured to quickly estimate an indicated torque of the engine in real time, according to a state feedback signals of engine inlet temperature and pressure, an air-fuel ratio, an ignition advance angle, and so on. The air-fuel ratio feedback control module is configured to subtract the estimated indicated torque from the target indicated torque to obtain a deviation of the indicated torque, and then convert the deviation into a feedback correction factor to make the engine reach the target torque faster and more accurately.

The torque coordination calculation module converting the target effective torque $T_{target\ effective}$ of the hybrid power control unit into the target indicated torque $T_{target\ indicated}$, includes an operation in the following.

$$T_{target\ indicated}=T_{target\ effective}+T_{friction}+T_{attachment}$$

In the operation, $T_{friction}$ is a mechanical friction torque of the engine, and $T_{attachment}$ is a consumed torque by an attachment.

Figure 2:
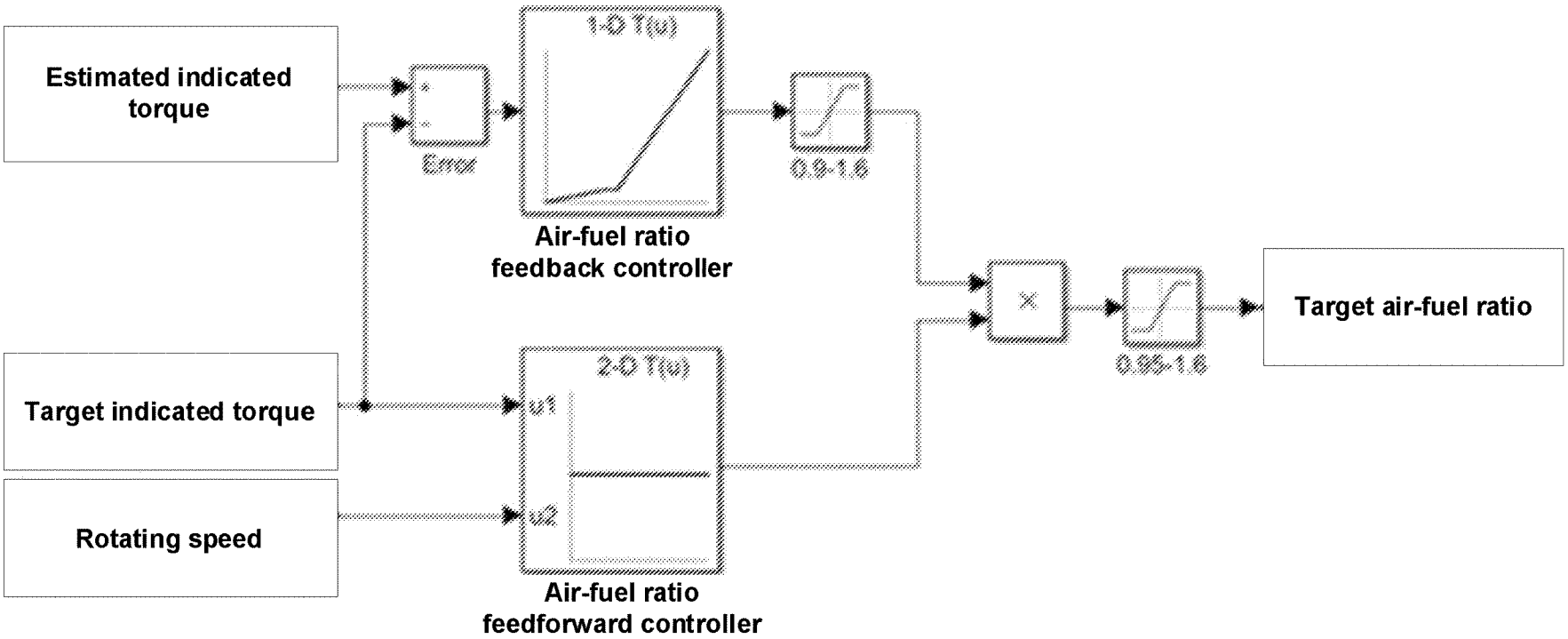
FIG. 2 is an illustration of an air-fuel ratio control model in the present disclosure.

FIG. 2 is an illustration of an air-fuel ratio control model in the present disclosure. The air-fuel ratio adopts a control strategy of feedforward and estimated torque feedback. For the air-fuel ratio feedforward control module, its input is the target indicated torque and engine speed, and output is the air-fuel ratio at each operating point under steady-state operating conditions. When influence of exhaust temperature is not considered, both are 1. For the air-fuel ratio feedback control module, its input is the deviation between the estimated indicated torque and the target indicated torque, and the feedback correction factor is output according to magnitude of the deviation in a table. The air-fuel ratio feedforward control signal is multiplied by the feedback correction factor as a target air-fuel ratio. If the target air-fuel ratio is within limit, the air-fuel ratio control parameter is the target air-fuel ratio. If the air-fuel ratio is out of the limit, the air-fuel ratio control parameter is the limit.

Figure 3:
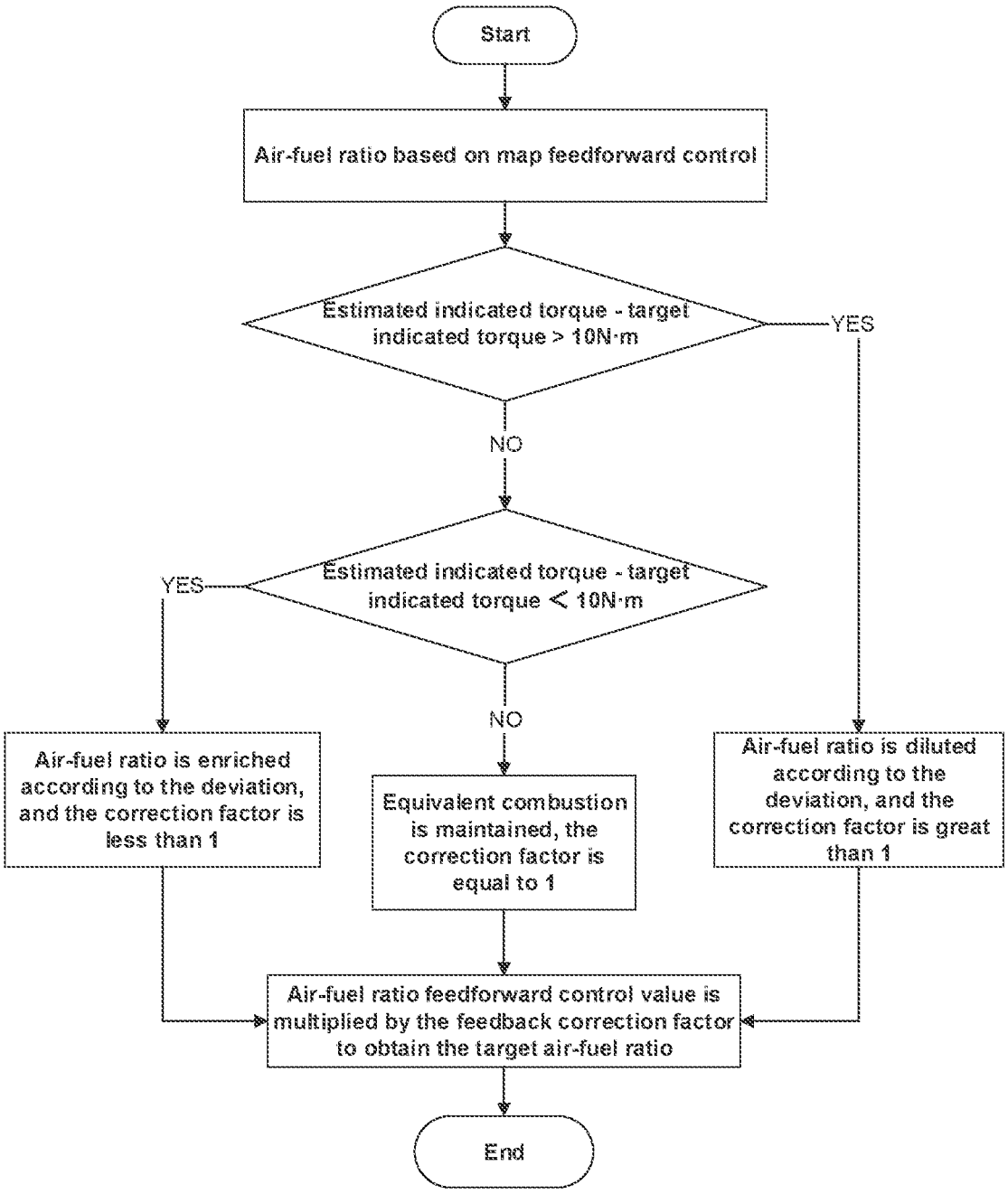
FIG. 3 is a flow chart of an air-fuel ratio control method in the present disclosure.
Figure 4:
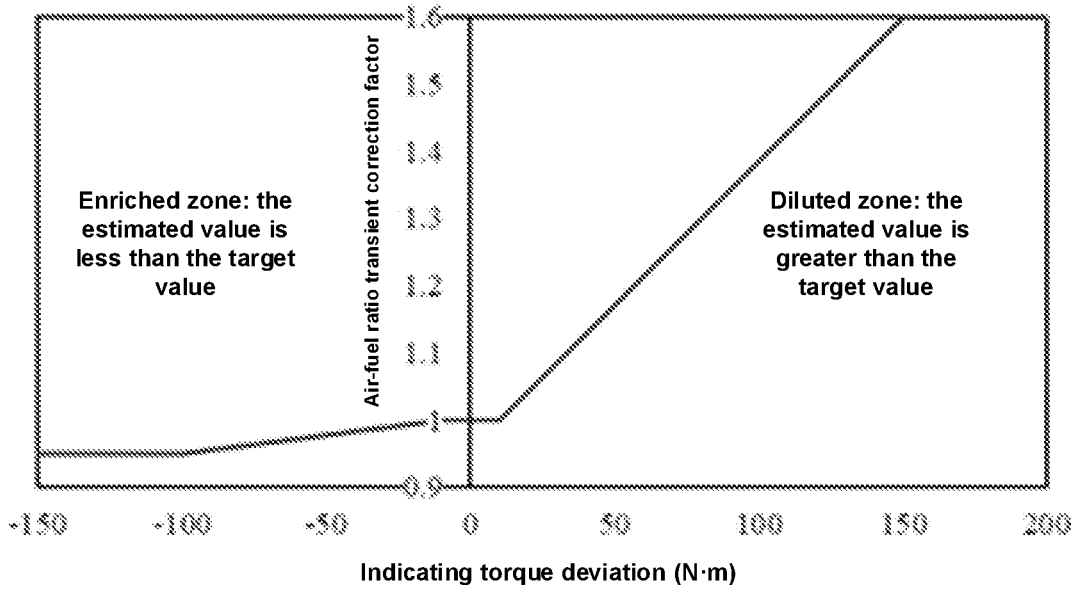
FIG. 4 is an illustration of the feedback correction factor correction strategy in the present disclosure.

FIG. 3 is a flow chart of an air-fuel ratio control method in the present disclosure. If a value that the target indicated torque minus the estimated indicated torque is greater than 10 N·m, the gas mixture is enriched, and the feedback correction factor is between 0.95-1. If the value that the target indicated torque minus the estimated indication is less than −10 N·m, a diluted combustion mode is adopted, and the feedback correction factor is between 1-1.6. If an absolute value of the deviation between the target indicated torque and the estimated indicated torque is less than 10 N·m, the feedback correction factor is 1. The specific feedback correction factor correction strategy is shown in FIG. 4.

The present disclosure further provides a system control method for an air-fuel ratio control system for a hybrid vehicle engine. The method includes: converting, by a torque coordination calculation module, a target effective torque of a hybrid power control unit into a target indicated torque; obtaining, by a torque estimation module, an estimated indicated torque according to an operating state of an engine; converting, by an air-fuel ratio feedforward control module, the target indicated torque of the torque coordination calculation module into an air-fuel ratio feedforward control signal according to a calibration parameter and engine speed; generating, by an air-fuel ratio feedback control module, a feedback correction factor based on a deviation between the estimated indicated torque of the torque estimation module and the target indicated torque of the torque coordination calculation module; and obtaining a target air-fuel ratio by correcting the air-fuel ratio feedforward control signal by a feedback correction factor; wherein the target air-fuel ratio is configured to act on the engine to achieve air-fuel ratio control.

The air-fuel ratio control system and method thereof of this embodiment have the following advantages.

An air-fuel ratio closed-loop control system of the hybrid vehicle engine enriches the gas mixture when the torque requirement rapidly rises. When the torque requirement rapidly reduces, the gas mixture is diluted. It may make the engine respond quickly and meet the torque satisfied the hybrid control unit requirements. A torque coordination calculation module is set. An interface module between an engine management system and a vehicle control system is responsible for the mutual conversion between the indicated torque and the effective torque. The indicated engine torque is directly affected by a heat release state of a combustion in a cylinder. The indicated torque is set as a control target of the engine control system, and it is conducive to precise control of the vehicle control system and the engine management system. Including the air-fuel ratio feedforward control module and the feedback control module, a simple and easy method is adopted to realize correction of the air-fuel ratio feedforward control signal, so that the air-fuel ratio control is more accurate.

What is claimed is:

1. An air-fuel ratio control system for a hybrid vehicle engine, comprising:

a torque coordination calculation module, configured to convert a target effective torque of a hybrid power control unit into a target indicated torque;

a torque estimation module, configured to obtain an estimated indicated torque according to an operating state of an engine;

an air-fuel ratio feedback control module, configured to generate a feedback correction factor based on a deviation between the estimated indicated torque of the torque estimation module and the target indicated torque of the torque coordination calculation module; and an air-fuel ratio feedforward control module, configured to convert the target indicated torque of the torque coordination calculation module into an air-fuel ratio feedforward control signal according to a calibration parameter and engine speed; wherein a target air-fuel ratio is obtained by correcting the air-fuel ratio feedforward control signal via the feedback correction factor generated by the air-fuel ratio feedback control module; and the target air-fuel ratio is configured to act on the engine to achieve air-fuel ratio control, wherein the target air-fuel ratio that is obtained by correcting the air-fuel ratio feedforward control signal via the feedback correction factor generated by the air-fuel ratio feedback control module is obtained by multiplying the air-fuel ratio feedforward control signal by the feedback correction factor that is generated according to a deviation between the estimated indicated torque and the target indicated torque.

2. The air-fuel ratio control system as claimed in claim 1, wherein the torque coordination calculation module is configured to convert the estimated indicated torque of the torque estimation module into an estimated effective torque; and the hybrid power control unit is configured to generate a motor torque control signal according to the estimated effective torque.

3. The air-fuel ratio control system as claimed in claim 1, wherein the torque coordination calculation module converting the target effective torque $T_{target\ effective}$ of the hybrid power control unit into the target indicated torque $T_{target\ indicated}$, comprises:

$$T_{target\ indicated}=T_{target\ effective}+T_{friction}+T_{attachment}$$

wherein, $T_{friction}$ is a mechanical friction torque of the engine, and $T_{attachment}$ is a consumed torque by an attachment.

4. The air-fuel ratio control system as claimed in claim 1, wherein the operating state of the engine comprises engine inlet temperature and pressure, air-fuel ratio, and ignition advance angle.

5. The air-fuel ratio control system as claimed in claim 1, wherein after the air-fuel ratio feedback control module obtains the deviation between the estimated indicated torque and the target indicated torque, the feedback correction factor is generated according to a table.

6. The air-fuel ratio control system as claimed in claim 1, wherein the target air-fuel ratio is equal to a product of the air-fuel ratio feedforward control signal and the feedback correction factor; if the target air-fuel ratio is within a limit, the target air-fuel ratio is input into the engine; and if the target air-fuel ratio is out of the limit, the limit is input into the engine.

7. The air-fuel ratio control system as claimed in claim 1, wherein if a value that the target indicated torque minus the estimated indicated torque is greater than 10 N·m, gas mixture is enriched, and the feedback correction factor is between 0.95-1; if the value that the target indicated torque minus the estimated indicated torque is less than −10N·m, a diluted combustion mode is adopted, and the feedback correction factor is between 1-1.6; and if an absolute value of the deviation between the target indicated torque and the estimated indicated torque is less than 10N·m, the feedback correction factor is 1.

8. A system control method for the air-fuel ratio control system for the hybrid vehicle engine as claimed in claim 1, comprising:

converting, by a torque coordination calculation module, a target effective torque of a hybrid power control unit into a target indicated torque;

obtaining, by a torque estimation module, an estimated indicated torque according to an operating state of an engine;

converting, by an air-fuel ratio feedforward control module, the target indicated torque of the torque coordination calculation module into an air-fuel ratio feedforward control signal according to a calibration parameter and engine speed;

generating, by an air-fuel ratio feedback control module, a feedback correction factor based on a deviation between the estimated indicated torque of the torque estimation module and the target indicated torque of the torque coordination calculation module; and obtaining a target air-fuel ratio by correcting the air-fuel ratio feedforward control signal by a feedback correction factor; wherein the target air-fuel ratio is configured to act on the engine to achieve air-fuel ratio control.

* * * * *